US006618011B2

(12) United States Patent
Eggleston et al.

(10) Patent No.: US 6,618,011 B2
(45) Date of Patent: Sep. 9, 2003

(54) ANTENNA TRANSDUCER ASSEMBLY, AND AN ASSOCIATED METHOD THEREFOR

(75) Inventors: Steve Eggleston, San Diego, CA (US); Saku Lahti, Kammenniemi (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/964,903

(22) Filed: Sep. 27, 2001

(65) Prior Publication Data

US 2002/0089454 A1 Jul. 11, 2002

Related U.S. Application Data

(60) Provisional application No. 60/240,166, filed on Oct. 13, 2000.

(51) Int. Cl.[7] ..... H01Q 1/38
(52) U.S. Cl. ..... 343/700 MS; 343/702
(58) Field of Search ..... 343/702, 700 MS; 455/89, 90

(56) References Cited

U.S. PATENT DOCUMENTS

| | | | | |
|---|---|---|---|---|
| 5,231,407 A | | 7/1993 | McGirr et al. | 343/700 MS |
| 5,959,582 A | * | 9/1999 | Kawahata et al. | 343/700 MS |
| 6,040,806 A | * | 3/2000 | Kushihi et al. | 343/853 |
| 6,300,909 B1 | * | 10/2001 | Tsubaki et al. | 343/700 MS |
| 6,343,208 B1 | * | 1/2002 | Ying | 455/90 |
| 6,384,786 B2 | * | 5/2002 | Ito et al. | 343/700 MS |
| 6,433,746 B2 | * | 8/2002 | Kushihi et al. | 343/700 MS |
| 6,448,932 B1 | * | 9/2002 | Stoiljkovic et al. | 343/700 MS |
| 6,452,548 B2 | * | 9/2002 | Nagumo et al. | 343/700 MS |

FOREIGN PATENT DOCUMENTS

| | | |
|---|---|---|
| DE | 195 12 003 | 10/1995 |
| DE | 198 60 912 | 7/2000 |
| EP | 0 955 689 | 11/1999 |
| FR | 2 754 942 | 10/1996 |
| WO | WO 99/60660 | 11/1999 |
| WO | WO 00/36700 | 6/2000 |
| WO | WO 01/04994 | 1/2001 |

* cited by examiner

*Primary Examiner*—Tan Ho
(74) *Attorney, Agent, or Firm*—Milan I. Patel

(57) ABSTRACT

An antenna transducer, and an associated method, for a mobile station operable in a cellular communication system. The mobile station also includes GPS receive circuitry for receiving and operating upon GPS (global positioning system) signals. The antenna transducer includes a primary antenna transducer portion for transducing signals generated to effectuate a communication service in the cellular communication system. And, the antenna transducer includes a second antenna transducer portion for transducing GPS signals transmitted to the mobile station. The primary and second antenna transducer portions are disposed upon a common substrate, and the second antenna transducer portion exhibits circular polarization characteristics.

18 Claims, 3 Drawing Sheets

ANTENNA TRANSDUCER ASSEMBLY, AND AN ASSOCIATED METHOD THEREFOR

CROSS-REFERENCE TO RELATED APPLICATIONS

The present invention claims priority of Provisional Patent Application No. 60/240,166, filed on Oct. 13, 2000.

The present invention relates generally to a manner by which to transduce communication signals at a mobile, or other communication, station operable in a cellular, or other radio, communication system. More particularly, the present invention relates to an assembly, and an associated method, at which signals generated pursuant to the effectuation of a communication service at the mobile service are transduced and also at which position-indicating signals, such as those generated during operation of a global positioning system (GPS) are transduced. Signals generated at the mobile station and transduced at the antenna transducer do not prevent detection at the antenna transducer of lower-power position indicating signals.

BACKGROUND OF THE INVENTION

The development, and implementation, of various types of mobile communication systems have been made possible as a result of advancements in communication technologies. A cellular communication system is an exemplary mobile communication system whose development, and implementation, has been made possible as a result of such communication-technology advancements.

In a cellular communication system, telephonic communication, of both voice and data, is generally possible. Other mobile communication systems analogously also provide for the communication of both voice and data. The use of a mobile communication system through which to communicate is advantageous as communications are effectuable by a user from almost any location with which a radio link between communication stations operable in the communication system can be formed. Improved mobility of communications is possible as communication links are formed upon radio links rather than through wire line connections.

A radio transceiver, sometimes referred to as a mobile station, is utilized by a user to communicate telephonically therethrough. The effectuation of the telephonic communications by way of a mobile station operable in the cellular communication system usually appear to the user generally to be similar to operation of conventional telephonic devices.

One aspect of a conventional telephonic device, however, is not easily replicated. The mobile nature of a mobile station operable in a cellular, or other mobile, communication system prevents simple tracking of the location at which a call is placed therethrough. The location at which a call is placed is important, for instance, when a call is placed to request emergency assistance by the user of the mobile station.

When an analogous call is originated at a conventional wire line device, the geographical position from which the call is originated is easily determinable. A simple mapping between the telephonic identity of the originating, wire line device and the location at which the device is installed, indicates the geographical positioning of the originating party. In contrast, because of the inherent mobility permitted of a mobile station, a user of a mobile station is able to originate a call from almost any location within a geographical area encompassed by the cellular, or other mobile, communication system. When the call is placed by way of a mobile station, therefore, the geographical position at which the call is originated is not readily determinable.

Emergency assistance personnel must be able to respond to a request for emergency assistance requested by a user of a mobile station. Otherwise, if the user of the mobile station is unable to identify to the emergency assistance personnel the location at which the call requesting the assistance is made, the emergency assistance personnel might be unable to provide the assistance.

GPS (global positioning system) technologies are implemented to provide geographical positioning information. GPS receivers are available to receive and to detect time-of-arrival signals generated by satellite-based transmitters. Signals received from three separate satellites at a GPS receiver are used by the GPS receiver to determine an accurate, three-dimensional geographical positioning indicia of the GPS receiver when the GPS receiver is synchronized to the satellite.

Incorporation of a GPS receiver into a mobile station used for voice and data communications permits the geographical positioning of the mobile station to be determinable. Such incorporation permits the geographical positioning of a mobile station to be determined through operation of the GPS receiver portion thereof, and appropriate circuitry provides such information to emergency assistance personnel when a call to an emergency assistance center is placed.

When the mobile station is operable in a cellular communication system, voice and data signals transduced by the mobile station are of relatively high power levels, e.g., power levels of one-half watt, or higher. Although the GPS signals and the cellular voice and data signals are generated within separate frequency bands, the relatively high energy levels of the cellular-system-generated signals, particularly the signals originated at the mobile station, include harmonic, and other, components that might interfere with detection at the mobile station of the GPS signals transmitted thereto.

Conventionally, therefore, when constructing the mobile station, the GPS antenna transducer is positioned as far away as possible from the antenna transducer used by the radio transceiver circuitry of the mobile station. The existing need to separate the antenna transducers is contrary to the competing design goal to miniaturize the mobile station. And, the conventional need to utilize separate antenna transducers increases the part-count of the mobile station, increasing, thereby, the construction complexity and expense associated with construction of the mobile station.

If a single antenna transducer assembly could be provided capable of use by both the radio transceiver circuitry and also the GPS, or other positional-indicia, circuitry of the mobile station, miniaturization and reduced-cost goals would be facilitated.

It is in light of this background information related to antenna transducers utilized in radio communications that the significant improvements of the present invention have evolved.

SUMMARY OF THE INVENTION

The present invention, accordingly, advantageously provides an assembly, and an associated method, by which to transduce communication signals at a mobile, or other communication, station operable in a radio communication system, such as a cellular communication system.

Through operation of an embodiment of the present invention, a manner is provided by which to transduce, at a single antenna transducer construction, both signals generated during normal operation of a cellular, or other mobile, communication system as well as position-indicating signals.

An antenna transducer constructed pursuant to an embodiment of the present invention is of compact dimensions, readily positioned within the housing of a mobile station. The antenna transducer is capable both of detecting the position-indicating signals and also transducing communication signals normally generated during operation of the cellular, or other mobile, communication system in which the mobile station, of which the antenna transducer forms a portion, is operable.

An antenna transducer constructed pursuant to an embodiment of the present invention integrates a primary cellular mobile telephone (CMT) antenna transducer part and a GPS (global positioning system) antenna transducer part. Because of the integration of the antenna transducer parts into a single assembly, reduced size requirements, reduced parts-counts, and corresponding reduced assembly-step requirements are provided. Increased miniaturization of packages in which a mobile station incorporating the antenna transducer of an embodiment of the present invention as well as reduced assembly costs are possible through use of an embodiment of the present invention.

A manner is provided by which to position the antenna transducer parts in a way that isolation between the two antenna transducers at a GPS frequency band is exceptionally good, for example, greater than 30 dBs, if optimally designed. And, the radiation properties, e.g., the polarization and radiation patterns of the antenna transducer part utilized for cellular, or other mobile, communications are suitable for GPS reception.

In one aspect of the present invention, a primary antenna transducer portion is formed of transmission lines disposed upon a substrate. The primary antenna transducer portion operates to transduce both forward-link signals and reverse-link signals generated during normal operation of a cellular, or other mobile, communication system. The transmission lines are implemented, for instance, as conductive paths formed of two arm members formed upon the substrate. Through appropriate selection of the lengths of the arm members of the primary antenna transducer portion, energy transduced thereat cancel each other at a selected operational frequency.

In a further aspect of the present invention, a second antenna transducer portion is also formed of a transmission line, disposed upon the same substrate upon which the primary antenna transducer portion is disposed. The second antenna transducer portion is positioned relative to the primary antenna transducer portion at a selected separation distance such that energy transduced by the primary antenna transducer portion induces, or facilitates, the second antenna transducer portion to exhibit circular polarization characteristics.

In one implementation, an antenna transducer construction is provided for a mobile station operable in a cellular, or other mobile, communication system which also includes a GPS (global positioning system) receiver. The GPS receiver is operable to receive GPS signals transmitted thereto at frequencies about a 1575.42 MHz frequency. The primary antenna transducer portion and the second antenna transducer portion are formed of transmission lines disposed upon a substrate. The portions are separated from one another in manners such that operation of the primary antenna transducer portion facilitates circular polarization characteristics to be exhibited by the second antenna transducer portion. A notch in the coupling between the antenna transducer portions is provided such that at the operational frequency of the GPS receiver, i.e., here, approximately 1575.42 MHz, energy of the primary antenna transducer portion is of reduced levels.

In these and other aspects, therefore, apparatus, and an associated method, is provided for a radio device. The radio device operates upon first radio signals communicated within a first frequency bandwidth and second radio signals communicated within a second frequency bandwidth. An antenna transducer is formed upon a substrate. A primary antenna transducer portion is disposed at the substrate. The primary antenna transducer portion transduces the first radio signals. The primary antenna transducer portion has a first primary antenna transducer part and a second primary antenna transducer part. A second antenna transducer portion is also disposed at the substrate. The second antenna transducer portion transduces the second radio signals. The second antenna transducer portion is positioned relative to the first and second primary antenna transducer parts such that energy transduced by the first and second primary antenna transducer parts cancel one another within the second frequency bandwidth.

A more complete appreciation of the present invention and the scope thereof can be obtained from the accompanying drawings which are briefly summarized below, the following detailed description of the presently-preferred embodiments of the invention, and the appended claims.

DETAILED DESCRIPTION

Figure 1:
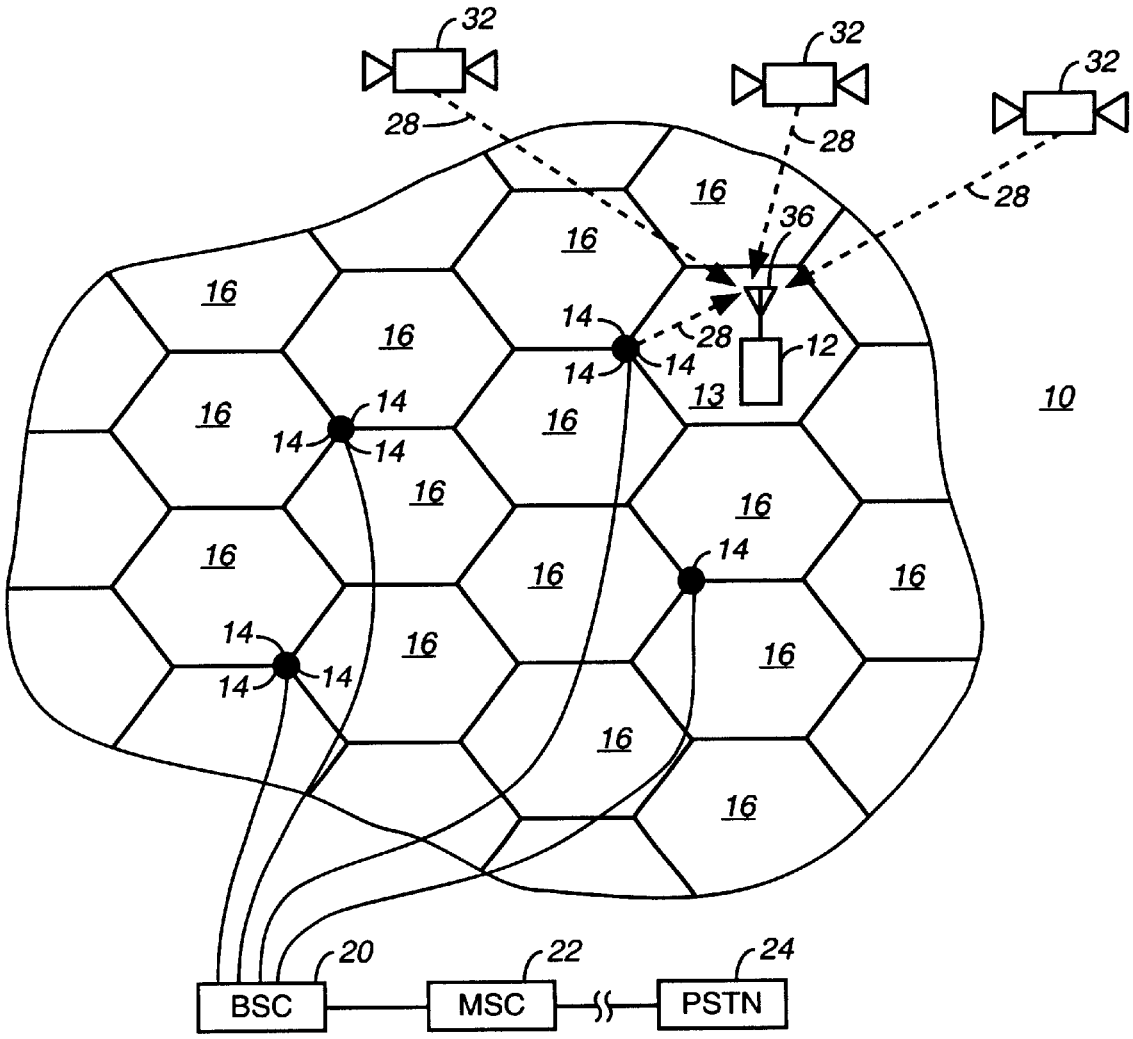
FIG. 1 illustrates a representation of a portion of a cellular communication system, together with satellite-based transmitters, such as those utilized in a GPS (global positioning system), and in which an embodiment of the present invention is operable.

Turning first to FIG. 1, a radio communication system, shown generally at 10, is operable to permit wireless communications with a mobile station 12. In the exemplary implementation shown in the figure, the radio communication system is formed of a cellular communication system constructed according to any of various standards promulgated by a standards-creating body. Operation of an embodiment of the present invention shall be described with respect to such a cellular communication system. In other implementations, other embodiments of the present invention are analogously operable in other communication systems to transduce communication signals at a mobile, or other, communication station.

The cellular communication system of which the radio communication system 10 is representative includes a network infrastructure having a plurality of spaced-apart base stations 14 positioned at spaced intervals throughout a geographical area encompassed by the communication system. The radio base stations are fixed-site radio transceivers capable of multi-user communications. In the exemplary implantation shown in the figure, groups of three radio base stations 14 are co-located. Each radio base station 14 forms a sector cell 16. For purposes of illustration, cells 16 are represented to be of hexagonal configurations.

Groups of the radio base stations 14 are coupled to a BSC (base station controller) 20 of which a single BSC 20 is shown in the figure. A BSC is operable to control operation of the radio base stations coupled thereto. Groups of the BSCs are coupled to an MSC (mobile switching center) 22, of which a single MSC 22 is shown in the figure. An MSC is operable, amongst other things, to perform switching operations. The MSC 22 is coupled to a PSTN (public-switched telephonic network) 24.

In contrast to many conventional wire line devices, the position of a wireless communication station, such as the mobile station 12, is not immediately discernible due to the inherent mobility of the wireless communications station. As also noted above, the ability to determine the position of the mobile station critically-important indicia, proposals have been set forth to include GPS (global positioning system) circuitry at the mobile station. GPS circuitry is operable to receive TOA-signals 28, here signals represented by satellite-transmitters 32.

When three, or more, TOA signals are detected at the mobile station, the geographical positioning of the mobile station is determinable by a conventional trilateration technique. The GPS circuitry, here positioned at the mobile station, determines the positioning of the mobile station by performing the trilateration technique upon the TOA-signals detected at the mobile station.

Pursuant to effectuation of communication services by way of the cellular communication system, forward-link signals communicated by a radio base station to a mobile station is converted out of electromagnetic form and into electrical form at an antenna transducer 36. And, reverse-link signals originated at the mobile station to be communicated to a radio base station pursuant to effectuation of the communication service are also transduced by the antenna transducer. And, the antenna transducer 36 is here further representative of the antenna transducer that detects, and converts into electrical form, the TOA signals 28 generated pursuant to the GPS. An embodiment of the present invention permits a single antenna transducer construction to transduce signals generated pursuant to effectuation of a communication service within the cellular, or other mobile, communication system, as well as, also, transduce the TOA signals generated pursuant to operation of the GPS. Although the frequency bands within which communication services are effectuated and within which GPS signals are transmitted are dissimilar, signal energy, particularly of reverse-link signals generated at the mobile station, when using conventional antenna transducer apparatus, might inhibit the detection of the GPS signals needed to permit the position of the mobile station to be determined. The antenna transducer construction of an embodiment of the present invention obviates the existing need for separate antenna transducer apparatus to be positioned apart from one another to minimize the possibility that operation of the antenna transducer to effectuate the communication service might inhibit operation of the GPS circuitry of the mobile station. As a result, because a single antenna construction is provided, the physical dimensional requirements of the antenna transducer are reduced relative to conventional implementations.

Figure 2:
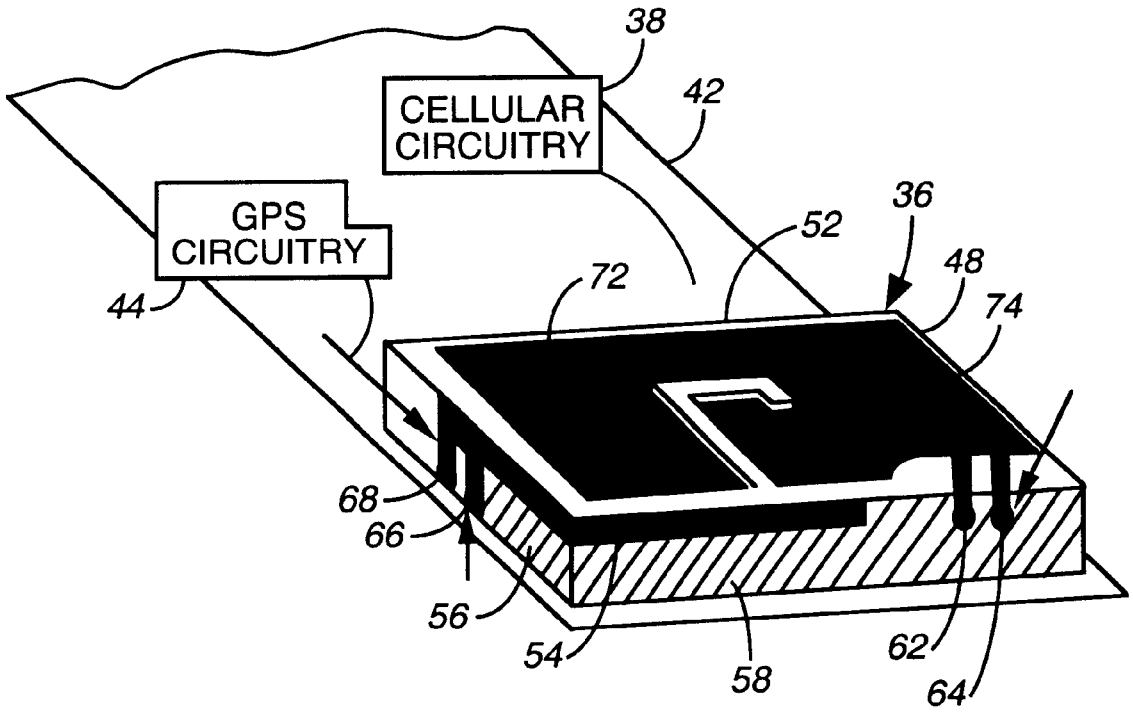
FIG. 2 illustrates a partial functional block, partial perspective view of the antenna transducer construction of an embodiment of the present invention.

FIG. 2 illustrates the antenna transducer 36 of an embodiment of the present invention. The antenna transducer transduces signals generated to effectuate a communication service and also detects TOA signals generated during operation of the GPS. The cellular-system communication circuitry, represented by the block 38, is disposed at a substrate 42, here a printed circuit board. GPS circuitry, here represented at 44, is also disposed at the printed circuit board. The circuitry 38 and 44 is coupled, by way of conductive paths, with connecting terminals of the antenna transducer 36. The antenna transducer is formed, or mounted upon, the same substrate 42 at which the circuitry 38 and 44 is disposed. The antenna transducer is formed of transmission lines, operable to transduce signals at the frequency bands in which the cellular communication system, and GPS, respectively, are operable.

A primary antenna portion 48 is formed upon a top face surface 52 of the substrate. And a second antenna portion 54 is formed upon two side surfaces 56 and 58 of the substrate.

The primary antenna portion 48 includes leads 62 and 64 extending over a third side surface to connect with the conductive paths extending from the circuitry 38 and 44. The path 62 forms a cellular communication system antenna feed line, and the path 64 forms a cellular communication system antenna ground lead. Analogously, the leads 66 and 68, extending beneath the second antenna portion 54, permit connection with conductive paths extending from the GPS circuitry 44. Namely, the lines 66 forms a GPS antenna feed, and the line 68 forms a GPS antenna ground.

The primary antenna portion 48 includes a first arm 72 and a second arm 74. The arms are of selected lengths and, in the exemplary implementation, are of dissimilar lengths. When the arms are of different lengths, phase differences exist between the radio frequency-energy coupled from the separate arms. Through appropriate selection of the lengths of the arms, and the relative differences therebetween, the primary antenna transducer portion 48 is caused to exhibit characteristics in which the energy of the separate arms 72 and 74 cancel one another out at the frequencies in which the GPS circuitry is operable. As, here, the TOA signals transmitted to the mobile station of which the antenna transducer 36 forms a portion are of approximately 1575.42 MHz frequency levels, the primary antenna transducer portion is of dimensions such that the RF energy of the separate arms 72 and 74 thereof cancel each other out at frequencies including the 1575.42 MHz frequency range.

The second antenna portion 54 formed of parts disposed upon the side surfaces 56 and 58 of the substrate extend in the directions defined by the side surfaces. Here, the side surfaces extend in perpendicular directions, and the parts of the second antenna transducer portion similarly extend in perpendicular directions. The currents in the parts of the second antenna transducer portion are caused thereby to exhibit right-handed circular polarization due to the configuration of the second antenna transducer portion and the relative positioning of the primary antenna transducer portion thereabove. Through appropriate placement of the antenna feed line 62, the energy transduced at the primary antenna transducer portion facilitates inducement of the circular polarization characteristics exhibited by the second antenna transducer portion. In the exemplary implementation, through appropriate positioning of the primary antenna transducer portion, the primary antenna transducer provides two dB of the RHCP antenna gain of the second antenna transducer.

The transducer is manufactured pursuant to a desired technique such as through the use of a MID (molded interconnect device) printed circuit board or a stamped metal sheet formed upon a plastic frame.

Figure 3:
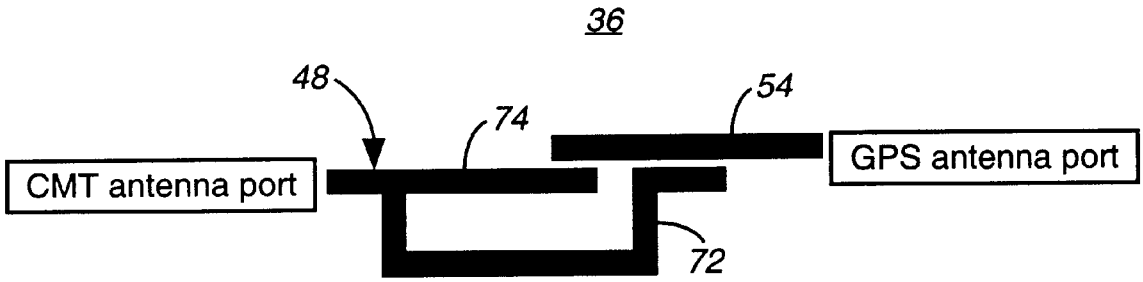
FIG. 3 illustrates a transmission-line model of the antenna transducer construction shown in FIG. 2.

FIG. 3 illustrates a transmission line representation of the antenna transducer 36. Here, the arms 72 and 74 of the primary antenna transducer portion are represented as separate transmission lines having a common connection. And, the second antenna transducer portion 54 is shown to be separated from the primary antenna transducer, but positioned such that energy transduced at the primary antenna portion induces the energy of the second antenna transducer portion to exhibit the desired circular polarization characteristics.

Figure 4:
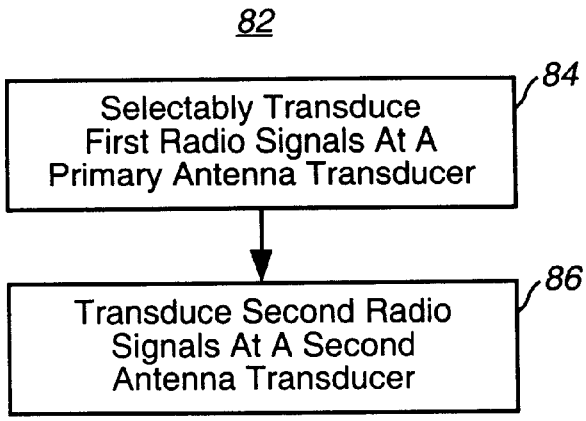
FIG. 4 illustrates a method flow diagram listing the method of operation of an embodiment of the present invention.

FIG. 4 illustrates a method, shown generally at 82, of an embodiment of the present invention. The method selectably transduces first and second radio signals. The first radio signals are communicated within a first frequency bandwidth, and the second radio signals are communicated within a second frequency bandwidth.

First, and as indicated by the block 84, the first radio signals are selectably transduced at a primary antenna transducer disposed upon a substrate. Then, and as indicated by the block 86, the second radio signals are selectably transduced at a second antenna transducer portion. The second antenna transducer portion is also disposed at the substrate. The first and second antenna transducers at which the first and second radio signals are selectably transduced, respectively, are positioned relative to one another such that energy transduced by the primary antenna transducers is at frequencies outside of the second frequency bandwidth.

The preferred descriptions are of preferred examples for implementing the invention, and the scope of the invention should not necessarily be limited by this description. The scope of the present invention is defined by the following claims.

What is claimed is:

1. In a radio device for operating upon first radio signals communicated within a first frequency bandwidth and second radio signals communicated within a second frequency bandwidth, an improvement of an antenna transducer formed upon a substrate having a face surface, a first side surface, and a second side surface, said antenna transducer comprising:

a primary antenna transducer portion disposed at the substrate and comprising a first transmission line formed at the face surface of the substrate, said primary antenna transducer portion for transducing the first radio signals, said primary antenna transducer portion having a first primary antenna transducer part and a second primary antenna transducer part; and a second antenna transducer portion also disposed at the substrate and comprising a second transmission line formed at the first side surface and at the second side surface of the substrate, said second antenna transducer portion for transducing the second radio signals, said second antenna transducer portion positioned relative to the first and second primary antenna transducer parts, respectively, such that energy transduced by said primary antenna transducer portion facilitates operation of said second antenna transducer portion.

2. The antenna transducer of claim 1 wherein the first frequency bandwidth encompasses a cellular-frequency band and wherein the first radio signals that said primary antenna transducer transduces are within the cellular-frequency band.

3. The antenna transducer of claim 2 wherein the first radio signals comprise reverse-link signals originated at the radio device and wherein said primary antenna transducer transduces the reverse-link signals originated at the radio device.

4. The antenna transducer of claim 1 wherein the second frequency bandwidth encompasses a positional-signal frequency band and wherein the second radio signals that said second antenna transducer transduces are within the positional-signal frequency band.

5. The antenna transducer of claim 4 wherein positional signals generated pursuant to operation of a GPS (global positioning system) are transmitted within the positional-signal frequency band and wherein the second radio signals that said second antenna transduces comprise the positional signals generated pursuant to the operation of the GPS.

6. The apparatus of claim 1 wherein the first side surface and the second side surface extend in substantially perpendicular directions and wherein said second antenna transducer portion includes a first part, formed at the first side surface, and a second part, formed at the second side surface, extending in substantially perpendicular directions with one another.

7. The apparatus of claim 6 wherein said second antenna transducer portion exhibits circular polarization characteristics.

8. The apparatus of claim 6 wherein said primary antenna transducer portion and said second antenna transducer portion are formed at the top face surface and at the first and second side surfaces at a separation distance relative to one another such that current generated at said primary antenna transducer portion during operation of the radio device induces, in part, the circular polarization characteristics at said second antenna transducer portion.

9. The apparatus of claim 1 wherein the first primary antenna transducer part comprises a first transmission-line arm of a first length and a second transmission-line arm of a second length, the first length dissimilar with the second length.

10. The apparatus of claim 9 wherein the first length and the second length are selected to cause a selected phase difference to be exhibited between the first radio signals transduced at the first transmission-line arm and the second transmission-line arm of said primary antenna transducer portion.

11. The apparatus of claim 10 wherein the first length and the second length are selected such that the selected phase difference caused to be exhibited between the first radio signals transduced at the first and second transmission-line arms, respectively, cancels the energy transduced thereat within the second frequency bandwidth.

12. The apparatus of claim 1 wherein the radio device comprises cellular communication circuitry dispersed upon the substrate and GPS (global positioning system) circuitry dispersed upon the substrate, the cellular communication circuitry connected to said primary antenna transducer portion and the GPS circuitry connected to said second antenna transducer portion.

13. In a method for communicating at a radio device that operates upon first radio signals communicated within a first frequency bandwidth and second ho signals communicated within a second frequency bandwidth, an improvement of a method selectably transducing the first and second radio signals, respectively, said method comprising:

selectably transducing the first radio signals at a primary antenna transducer portion posed at a substrate and comprising a first transmission line formed at a face surface of the substrate; and selectably transducing the second radio signals at a second antenna transducer portion disposed at the substrate and comprising a second transmission line formed at a first side face and at a second side surface of the substrate, the first and second antenna transducers at which the first and second radio signals are transduced, respectively, positioned relative to one another such that energy selectably transduced by the primary antenna transducer is at frequencies outside of the second frequency bandwidth.

14. The method of claim 13 wherein the radio device comprises a mobile station operable to transceive traffic signals and operable to receive position-indicating signals, and wherein the first radio signals selectably transduced during said operation of selectably transducing the first radio signals comprise the traffic signals.

15. The method of claim 14 wherein the second radio signals selectably transduced during said operation of selectably transducing the second radio signals comprise the position-indicating signals.

16. The method of claim 14 wherein the primary antenna transducer at which the first radio signals are selectably transduced during said operation of selectably transducing the first radio signals and the second antenna transducer at which the second radio signals are selectably transduced during said operation of selectably transducing the second radio signals are both formed of transmission lines disposed upon a substrate.

17. The method of claim 16 wherein the primary antenna transducer at which the first radio signals are selectably transduced during said operation of selectably transducing the first radio signals comprises a first arm of a first selected length and a second arm of a second selected length, the first length dissimilar in size with the second length.

18. The method of claim 16 wherein the second antenna transducer portion exhibits circular polarization characteristics.

* * * * *